US006062470A

United States Patent [19]

Robichaud

[11] Patent Number: 6,062,470

[45] **Date of Patent: *May 16, 2000**

[54] TEAR-AWAY PACKAGE OPENING

[75] Inventor: Arthur W. Robichaud, Kittery, Me.

[73] Assignee: SIG Combibloc Inc., Columbus, Ohio

[ * ] Notice: This patent is subject to a terminal disclaimer.

[21] Appl. No.: 09/054,795

[22] Filed: Apr. 3, 1998

Related U.S. Application Data

[60] Provisional application No. 60/043,372, Apr. 4, 1997.

[51] Int. Cl.[7] ..... B65D 5/54

[52] U.S. Cl. ..... 229/216; 229/237; 229/241; 229/242; 493/63; 493/110; 493/148

[58] Field of Search ..... 229/235, 237, 229/241, 242, 216, 206; 493/63, 73, 110, 148, 372

[56] References Cited

U.S. PATENT DOCUMENTS

| | | | |
|---|---|---|---|
| 3,347,444 | 10/1967 | Rausing et al. | 229/216 |
| 3,909,582 | 9/1975 | Bowen | 229/237 |
| 4,301,927 | 11/1981 | Carlsson et al. | 229/216 |
| 4,367,828 | 1/1983 | Reil | 229/216 |
| 4,591,091 | 5/1986 | Wise | 229/206 |
| 4,655,387 | 4/1987 | Magnusson | 229/216 |
| 4,703,876 | 11/1987 | Reil | 229/216 |
| 4,915,236 | 4/1990 | Kamin et al. | 229/216 |
| 5,188,285 | 2/1993 | Nilsson et al. | 229/216 |
| 5,306,533 | 4/1994 | Robichaud et al. | 428/34.2 |
| 5,470,016 | 11/1995 | Ljungstrom et al. | 229/237 |
| 5,688,463 | 11/1997 | Robichaud et al. | 264/400 |

FOREIGN PATENT DOCUMENTS

| | | | |
|---|---|---|---|
| 179240 | 4/1986 | European Pat. Off. | 229/216 |
| 6600713 | 8/1966 | Netherlands | 229/242 |

*Primary Examiner*—Gary E. Elkins
*Attorney, Agent, or Firm*—Standley & Gilcrest LLP

[57] ABSTRACT

The present invention is directed to a package having a tear-away opening. The package comprises an outer substrate layer, an inner aseptic layer secured to the outer substrate layer, and a cut in the outer substrate layer. In order to preserve the product in the package, the cut is of a predetermined depth such that the cut does not puncture the inner aseptic layer. The cut, however, is sufficiently deep so that a predetermined portion of the package may be torn off at the cut. The present invention also includes methods for manufacturing and opening a package having a tear-away opening. The method for manufacturing a package having a tear-away opening generally includes the steps of providing an outer substrate layer, securing an inner aseptic layer to the outer substrate layer, making a cut of predetermined depth in the outer substrate layer such that the cut does not puncture the inner aseptic layer, and then forming a package. After the package has been formed, a predetermined portion of the package may be torn away at the cut. The method for opening a package having a tear-away opening is initiated by extending a flap from a side of the package. After the flap is extended, at least a portion of a joint is extended from the top and the flap. At least a portion of the top is then moved in a direction away from the bottom of the package. After the top is moved, a predetermined portion of the package may be torn off at the cut.

31 Claims, 5 Drawing Sheets

TEAR-AWAY PACKAGE OPENING

This application claims the benefit of U.S. Provisional Application No. 60/043,372, filed Apr. 4, 1997.

BACKGROUND AND SUMMARY OF THE INVENTION

The present invention relates generally to an aseptic package, and more particularly, to an aseptic package having a tear-away opening. Aseptic packages do not support the growth of living microorganisms. As a result, aseptic packages may provide a shelf life of greater than one year without the use of preservatives or refrigeration.

Aseptic packages are commonly used to store foods and beverages that are sensitive to oxygen and/or light. In particular, aseptic packages may be used to store foods and beverages such as juice, wine, gravies, and other liquid or semi-liquid foodstuffs that quickly deteriorate after exposure to oxygen or light. However, the opening facilitators of known aseptic packages are designed primarily for use only with liquid foodstuffs such as juice and wine.

Known opening facilitators include caps, flip-top lids, depressable push tabs, and straw holes. While suitable for use with liquid foodstuffs, these opening facilitators may not be adapted to dispense semi-liquid or viscous foodstuffs like gravy. In addition, these opening facilitators may require extraneous components that must be attached to the package by means such as adhesives. Consequently, a need exists for an opening facilitator that may be easily and efficiently used to pour semi-liquid and viscous foodstuffs. A need also exists for an opening facilitator that does not require extraneous components.

The present invention is designed to satisfy some or all of these needs. The present invention includes a package having a tear-away opening. In general, the package comprises an outer substrate layer which may include a paperboard layer, an inner aseptic layer secured to the outer substrate layer, and a cut in the outer substrate layer. The package also preferably has a top and a flap. In order to preserve the product in the package, the cut is of a predetermined depth such that the cut does not puncture the inner aseptic layer. The cut, however, is sufficiently deep so that a predetermined portion of the package may be torn off at the cut. In a preferred embodiment of the package, a predetermined area of the top may be torn off at the cut. A predetermined area of the top may include the entire top. It is also preferred that a predetermined area of the flap may be torn off at the cut. Likewise, a predetermined area of the flap may include the entire flap.

The inner aseptic layer may include an oxygen barrier layer which substantially prevents the transmission of oxygen through the package. In addition, the inner aseptic layer may include a photic barrier layer which substantially controls light transmission through the package. Since the cut does not puncture the inner aseptic layer, it is preferred that the cut does not compromise the aseptic quality of the inner aseptic layer.

The cut is preferably made by a laser, and it may be a perforated cut or a scored cut. The cut may have a predetermined shape such that a pouring spout is created when a predetermined portion of the package is torn off at the cut.

The present invention also includes a method for manufacturing a package that has a tear-away opening. A preferred method generally includes the steps of providing an outer substrate layer, securing an inner aseptic layer to the outer substrate layer, making a cut of predetermined depth in the outer substrate layer such that the cut does not puncture the inner aseptic layer, and then forming a package. After the package has been formed, a predetermined portion of the package may be torn away from the package at the cut.

The package is preferably made by first forming a sleeve comprised of the outer substrate layer and the inner aseptic layer. The bottom of the package may then be formed from the sleeve. It is preferred that the package be filled with a predetermined amount of a product after the bottom is formed. Once the product has been placed in the package, the top of the package may be formed. In forming the top of the package, it is preferred that at least one flap also be formed which extends down from the top of the package.

Another embodiment of the present invention provides a method for opening a package that has a top, a bottom, a flap, a joint, a plurality of sides, and a cut. The package is preferably an aseptic package. In order to open the package, the flap is first extended from a side of the package. After the flap is extended, at least a portion of the joint is extended from the top and the flap. At least a portion of the top is then moved in a direction away from the bottom of the package. The portion of the top may be moved in a direction away from the bottom of the package by lifting the predetermined portion of the joint and/or by squeezing opposing sides of the package. After the portion of the top is moved, a predetermined portion of the package may be torn off at the cut. It is preferred that a predetermined area of the top and a predetermined area of the flap may be torn off at the cut.

The package may have a second flap. In that case, it is preferred that the second flap also be extended from a side of the package. After extending the second flap from a side of the package, substantially all of the joint is preferably extended from the top and the flaps of the package. Substantially all of the top may then be moved in a direction away from the bottom of the package, and a predetermined portion of the package may be torn off at the cut.

The present invention is primarily designed for use with semi-liquid or viscous foodstuffs such as gravies, sauces, pastes, and gels. However, the present invention may also be used in conjunction with liquid foodstuffs such as juice and wine. In addition, other objects and advantages of the present invention will be readily apparent from the following descriptions of the drawings and preferred embodiments.

DETAILED DESCRIPTION OF PREFERRED EMBODIMENT(S)

The present invention is directed to an aseptic package having a tear-away opening. The present invention also includes a method for manufacturing an aseptic package having a tear-away opening. Moreover, the present invention provides a method for opening a package having a tear-away opening.

Figure 1:
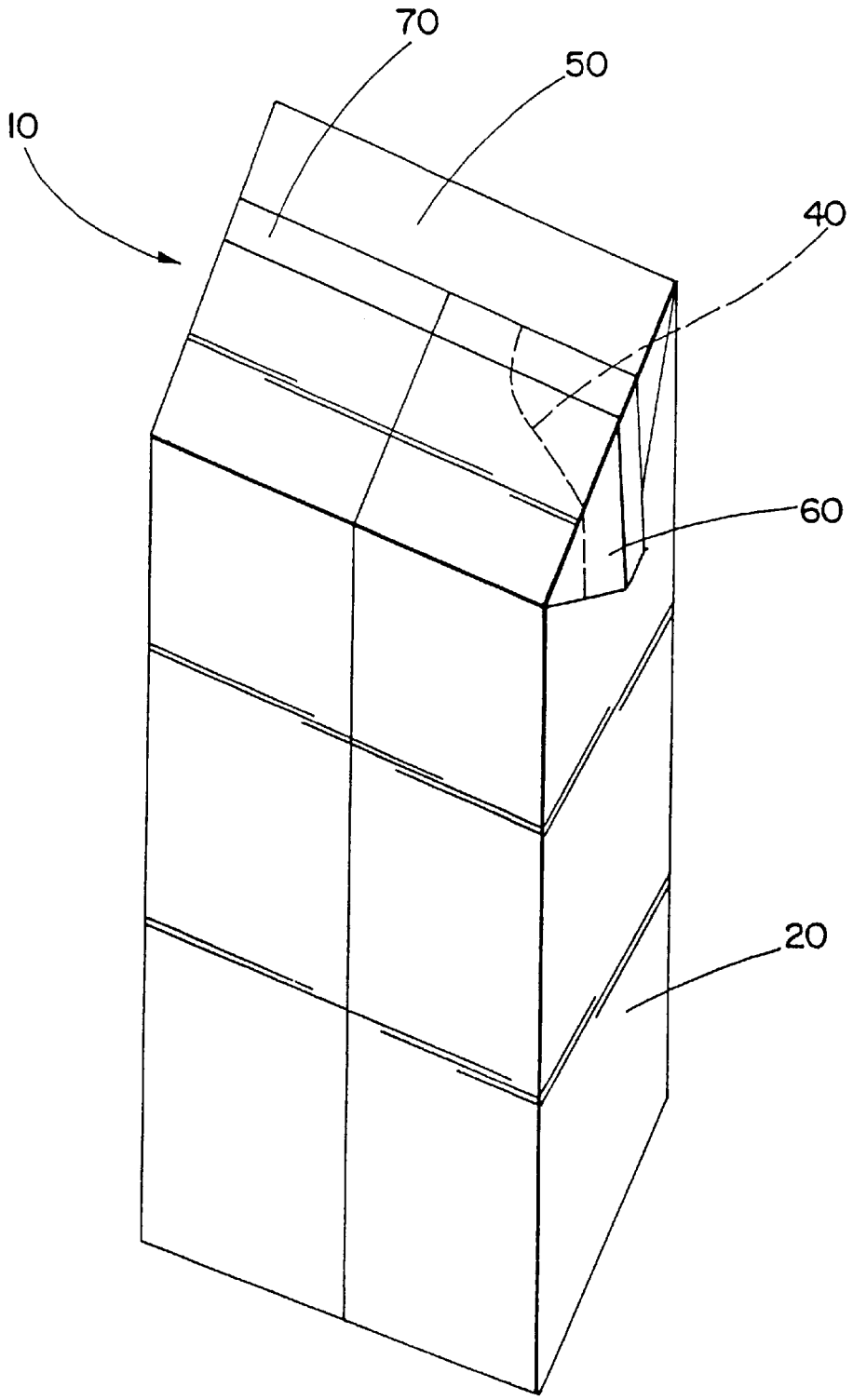
FIG. 1 is a perspective view of a preferred embodiment of a package of the present invention.

FIGS. 1 through 4 illustrate a preferred embodiment of a package of the present invention. FIG. 1 shows the package 10 in a folded, sealed state. The package 10 includes an outer substrate layer 20, an inner aseptic layer 30, and a cut 40. The package 10 may also have a top 50, at least one flap 60, 62, and a joint 70. The at least one flap 60, 62 preferably extends from the top 50, and the joint 70 preferably forms portions of the top 50 and the flaps 60, 62. In FIG. 1, a portion of the cut 40 is obscured by the joint 70.

In addition to the outer substrate layer 20 and the inner aseptic layer 30, the package 10 preferably includes other layers such as those taught by U.S. Pat. No. 5,306,533, the disclosure of which is hereby incorporated by reference. However, the other layers are not pertinent to the description of the package 10 of the present invention. Therefore, the other layers are not described or shown in the figures.

The outer substrate layer 20 includes a substrate such as a layer of paperboard. However, it should be recognized that other suitable substrate materials may be used in the present invention. In addition, the thickness of the substrate may vary depending on the application for the package 10.

The inner aseptic layer 30 is secured to the outer substrate layer 20. The inner aseptic layer 30 may include any material that impedes the deterioration of the product in the package 10. Since exposure to oxygen may accelerate the deterioration of the product, the inner aseptic layer 30 preferably includes an oxygen barrier layer which substantially prevents the transmission of oxygen through the package 10. Similarly, a product may be sensitive to exposure to light. Accordingly, the inner aseptic layer 30 may also include a photic barrier layer which substantially controls light transmission through the package 10.

The cut 40 is of a predetermined depth in the outer substrate layer 20 so that the cut 40 does not puncture the inner aseptic layer 30. In addition, it is preferred that the cut 40 does not compromise the aseptic quality of the inner aseptic layer 30. However, the cut 40 is sufficiently deep so that a predetermined portion of the package 10 may be torn off at the cut 40.

It should be recognized that FIG. 1 shows only one embodiment of the location and path of the cut 40. The cut 40 may be made anywhere on the outer substrate layer 20 that allows a user to grasp and tear off a predetermined portion of the package 10. It is preferred that the cut 40 has a predetermined shape such that a pouring spout is created when a predetermined portion of the package 10 is torn off. It is also preferred that the cut 40 is located such that unnecessary spillage of the product does not result when a predetermined portion of the package 10 is torn off. Moreover, it is preferred that the cut 40 is located such that the storage capacity of the package 10 is not unnecessarily limited.

The cut 40 is preferably made by a laser. A preferred process for laser treating material is disclosed in U.S. Pat. No. 5,688,463, the disclosure of which is hereby incorporated by reference. The cut 40 may be of any type that enables a user to tear off a predetermined portion of the package 10. However, it is preferred that the cut 40 is a perforated cut or a scored cut.

Figure 2:
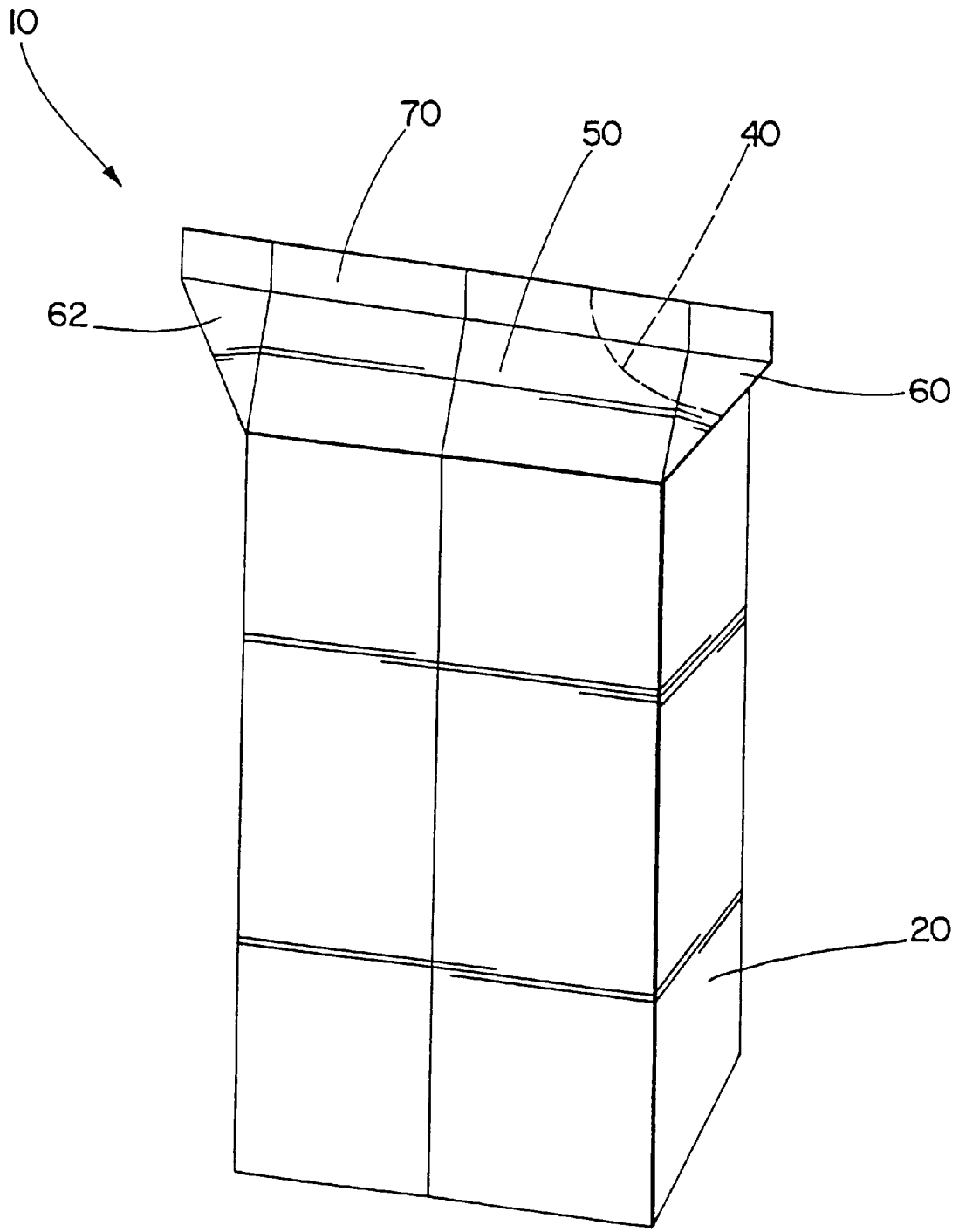
FIG. 2 is a perspective view of the package of FIG. 1 in a preferred position for a predetermined portion of the package to be torn off.

FIG. 2 shows the package 10 in a sealed, but partially unfolded, state in which a user may grasp and tear off a predetermined portion of the package 10 at the cut 40. In FIG. 2, the flaps 60, 62 have been extended from the sides of the package 10. In addition, the joint 70 has been extended from the top 50 of the package 10, and the top 50 has been moved in a direction away from the bottom of the package 10.

Figure 3:
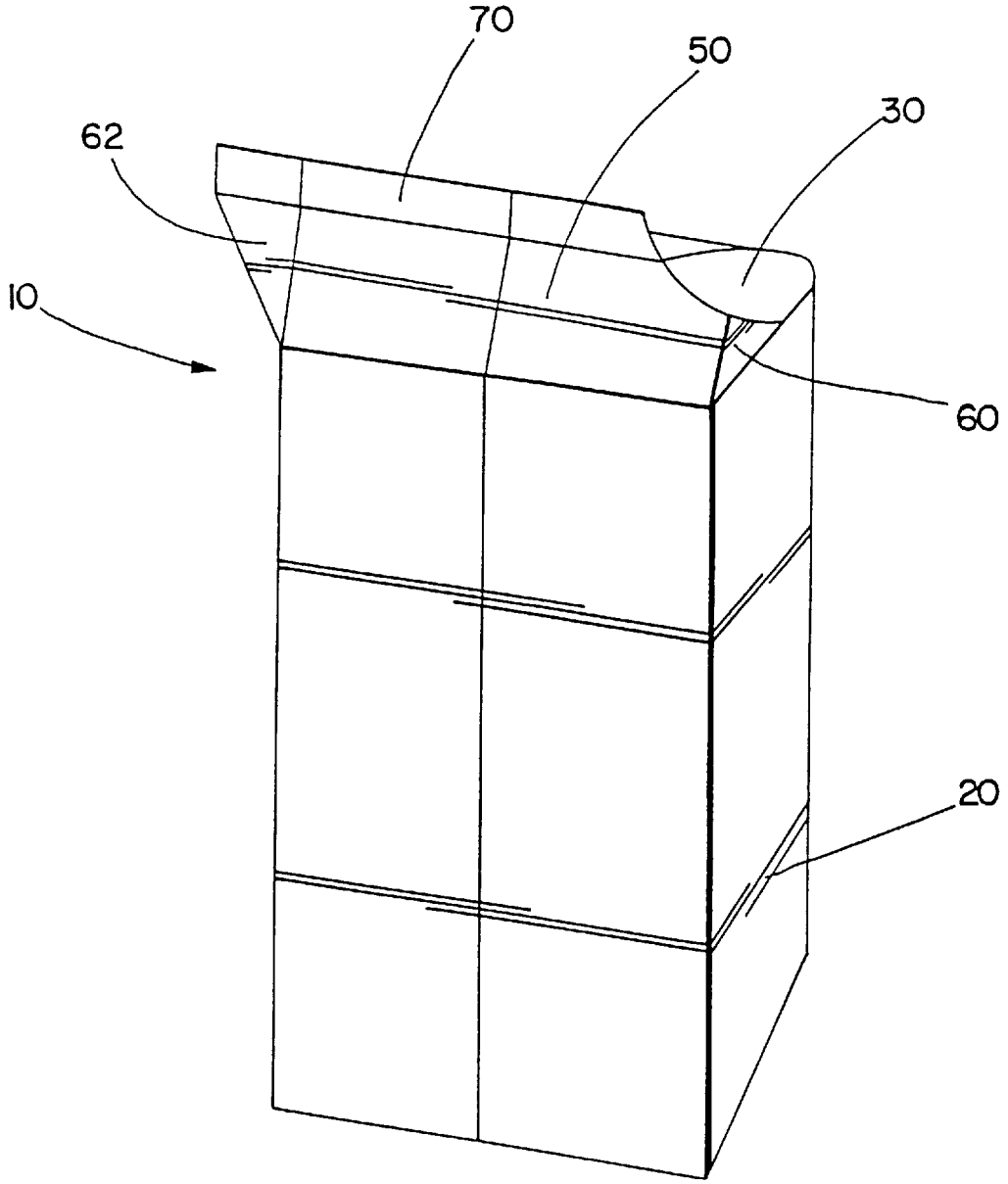
FIG. 3 is a perspective view of the package of FIG. 2 with a predetermined portion of the package torn off.
Figure 4:
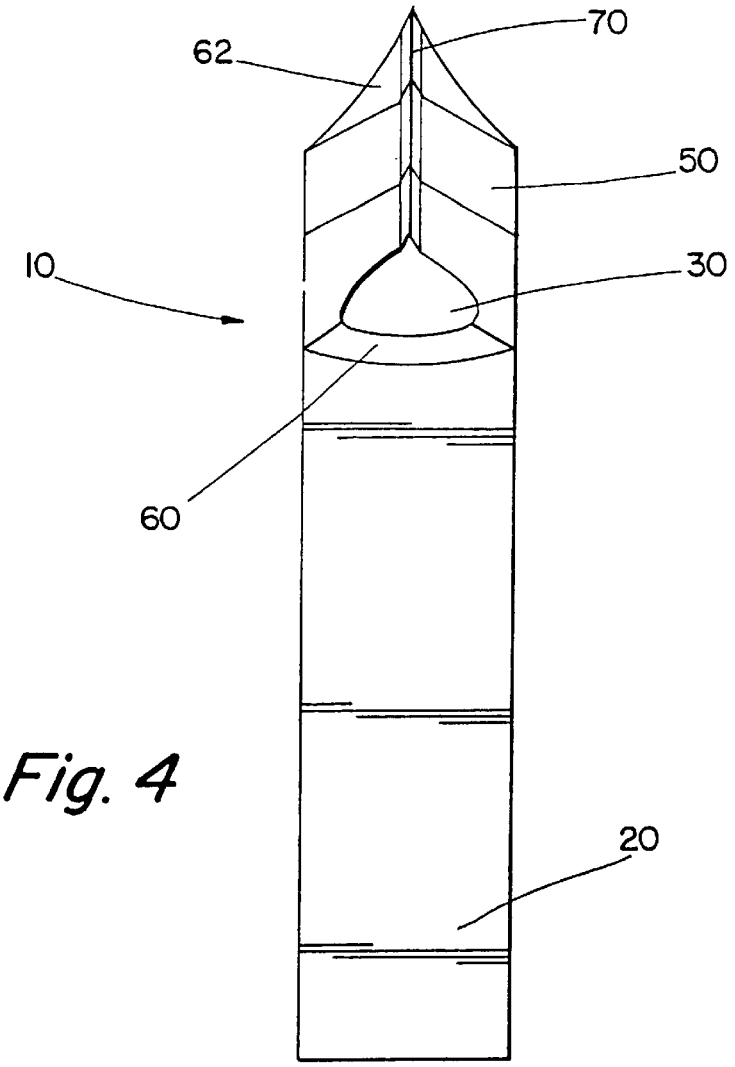
FIG. 4 is a side perspective view of the package of FIG. 3.

FIGS. 3 and 4 illustrate the package 10 after a predetermined portion of the package 10 has been torn off. In order to tear off a predetermined portion of the package 10, a user may first grasp the predetermined portion. After grasping the predetermined portion, the user may pull it away from the package 10 at the cut 40.

Figure 5:
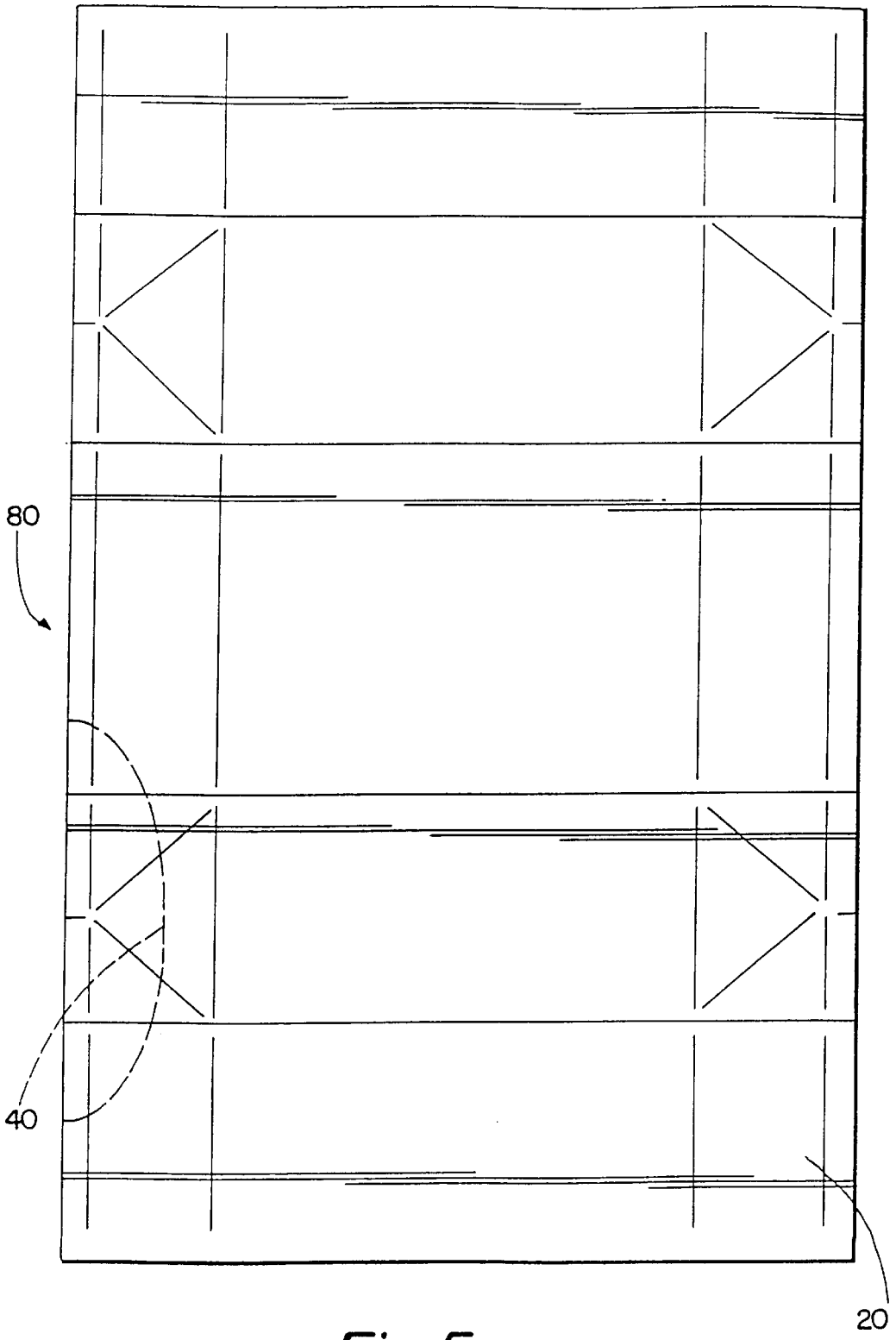
FIG. 5 is an outer plan view of a preferred embodiment of a flat card of the present invention.

A preferred method of manufacturing a package 10 of the present invention involves a flat card. FIG. 5 illustrates a preferred embodiment of a flat card 80 which may be folded into a preferred embodiment of the package 10 of the present invention. Those skilled in the art, however, will recognize that other embodiments of a flat card 80 may be folded into different embodiments of a package 10 of the present invention.

The flat card 80 is formed by providing an outer substrate layer 20 and then securing an inner aseptic layer 30 to the outer substrate layer 20. After the flat card 80 is formed, a cut 40 of predetermined depth is made in the outer substrate layer 20 so that the cut 40 does not puncture the inner aseptic layer 30. The flat card 80 may have creases which facilitate its transition into a package 10. While the cut 40 may intersect the creases, it is preferred that the path of the cut 40 does not run directly on any of the creases.

After the cut 40 is made in the outer substrate layer 20, the flat card 80 is folded into a package 10. In one preferred method of folding a flat card 80 into a package 10, the flat card 80 is first formed into a sleeve. An end of the sleeve is then folded to form the bottom of the package 10. After the bottom of the package 10 is formed, the interior of the package 10 is preferably sterilized. A product which is preferably sterilized may then be deposited in the package 10 through the open end of the sleeve. It should be noted that a predetermined amount of product should be deposited in the package 10 so that a user does not unintentionally contact or spill the product when tearing off a predetermined portion of the package 10. Once the product has been deposited, the open end of the sleeve may be folded to form the top 50 of the package 10. In forming the top 50 of the package 10, it is preferred that at least one flap 60, 62 also be formed which extends down from the top 50 of the package 10.

The cut 40 is preferably made in the flat card 80 before the flat card 80 is folded into the package 10. The cut 40 is preferably made by a laser. The cut 40 may be made by any laser system which may cause the local evaporation of material from the flat card 80. As opposed to mechanical cutting means, a laser may make tear lines which are more precise, which are easier to sever, and which require less force to sever. In addition, another benefit of using a laser system is that precise right angle cuts or incisions may be made without rotating the flat card 80. Conversely, mechanical cutting means typically can only make curved corners. Depending on the type of force applied to the predetermined portion of the package 10, a cut 40 having precise right angles may facilitate the removal of a predetermined portion of the package 10.

Figure 6:
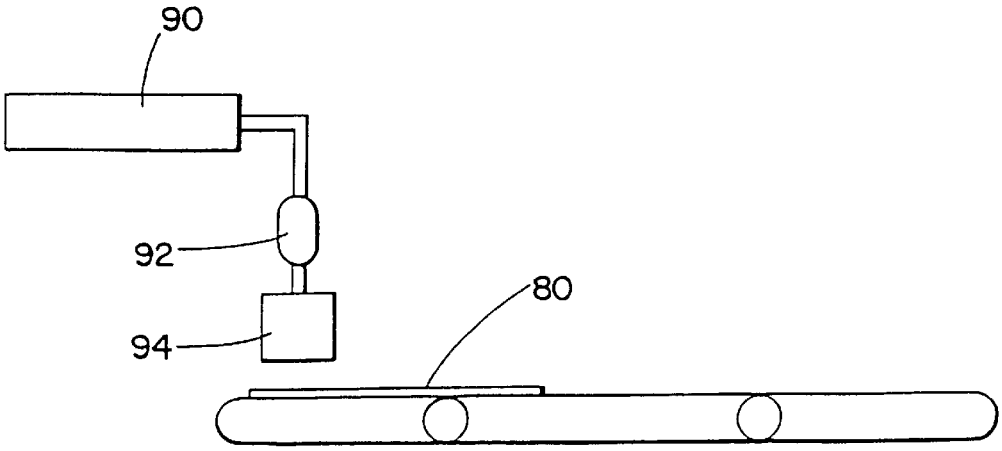
FIG. 6 is a schematic view of a preferred embodiment of a laser system which may be used in a preferred method of the present invention.

FIG. 6 illustrates a preferred embodiment of a laser system which may be used to make the cut 40. As shown in FIG. 6, the laser 90 may generate a laser beam and supply it to a z-axis focus 92. The laser beam may then travel through a two-axis laser galvo 94 which may comprise X and Y-axis positioning mirrors. The laser beam may then be guided through its desired pattern on a flat card 80.

The present invention also provides a method for opening a package. A preferred method of the present invention may be utilized to open the package 10 illustrated by FIG. 1. However, it should be recognized that the method is not limited to opening the package 10 illustrated by FIG. 1. It should also be recognized that the method is not limited to opening aseptic packages. The method of the present invention may be used to open any type of package that has a top, a bottom, a flap, a joint, a plurality of sides, and a cut.

A preferred method of the present invention will be described with reference to FIGS. 1 through 4. In order to open the package 10, flaps 60, 62 are first extended from opposing sides of the package 10. After the flaps 60, 62 are extended, the joint 70 is extended from the top 50 and the flaps 60, 62. The top 50 is then moved in a direction away from the bottom of the package 10. The top 50 may be moved in a direction away from the bottom of the package 10 by lifting the joint 70 and/or by squeezing opposing sides of the package 10. After the top 50 is moved, a predetermined portion of the top 50 and a predetermined portion of the flap 60 may be torn off at the cut 40.

The preferred embodiments herein disclosed are not intended to be exhaustive or to unnecessarily limit the scope of the invention. The preferred embodiments were chosen and described in order to explain the principles of the present invention so that others skilled in the art may practice the invention. Having shown and described preferred embodiments of the present invention, those skilled in the art will realize that many variations and modifications may be made to affect the described invention. Many of those variations and modifications will provide the same result and fall within the spirit of the claimed invention. It is the intention, therefore, to limit the invention only as indicated by the scope of the claims.

What is claimed is:

1. A package having a bottom and a top, said top being a generally horizontal top surface of said package when in a closed position, said package comprising:

an outer substrate layer;

an inner aseptic layer secured to said outer substrate layer; and a cut of predetermined depth in said outer substrate layer such that said cut does not puncture said inner aseptic layer;

whereby a predetermined portion of said package is adapted to be torn off at said cut thereby providing an opening through which a product in said package may be dispensed;

whereby said predetermined portion of said package includes an area of said top;

whereby at least a portion of said opening is adapted to extend through said top of said package; and whereby said package is adapted to substantially retain said product while being rested on said bottom after said predetermined portion has been torn off.

2. The package of claim 1 wherein said inner aseptic layer includes an oxygen barrier layer which substantially prevents the transmission of oxygen through said package.

3. The package of claim 1 wherein said inner aseptic layer includes a photic barrier layer which substantially controls light transmission through said package.

4. The package of claim 1 wherein said cut does not compromise the aseptic quality of said inner aseptic layer.

5. The package of claim 1 wherein said cut has a predetermined shape such that a pouring spout is created when said predetermined portion of said package is torn off at said cut.

6. The package of claim 1 wherein said cut is a perforated cut.

7. The package of claim 1 wherein said cut is a scored cut.

8. The package of claim 1 wherein said cut is a laser cut.

9. The package of claim 1 wherein said outer substrate layer includes a paperboard layer.

10. The package of claim 1 wherein said area of said top is an end portion of said top.

11. The package of claim 1 wherein:

said package has a flap; and said predetermined portion of said package includes an area of said flap, said area of said flap adapted to be torn off at said cut.

12. A method for manufacturing a package having a tear-away opening, said method comprising:

providing an outer substrate layer;

securing an inner aseptic layer to said outer substrate layer;

making a cut in said outer substrate layer such that said cut does not puncture said inner aseptic layer; and forming said package having a bottom and a top, said top being a generally horizontal top surface of said package when in a closed position;

wherein a predetermined portion of said package is adapted to be torn off at said cut thereby providing an opening through which a product in said package may be dispensed;

wherein said predetermined portion of said package includes an area of said top;

wherein at least a portion of said opening is adapted to extend through said top of said package; and wherein said package is adapted to substantially retain said product while being rested on said bottom after said predetermined portion has been torn off.

13. The method of claim 12 wherein said inner aseptic layer includes an oxygen barrier layer which substantially prevents the transmission of oxygen through said package.

14. The method of claim 12 wherein said inner aseptic layer includes a photic barrier layer which substantially controls light transmission through said package.

15. The method of claim 12 wherein said cut does not compromise the aseptic quality of said inner aseptic layer.

16. The method of claim 12 wherein said cut has a predetermined shape such that a pouring spout is created when said predetermined portion of said package is torn off at said cut.

17. The method of claim 12 wherein said cut is a perforated cut.

18. The method of claim 12 wherein said cut is a scored cut.

19. The method of claim 12 wherein said cut is made by a laser.

20. The method of claim 12 wherein said outer substrate layer includes a paperboard layer.

21. The method of claim 12 wherein said area of said top is an end portion of said top.

22. The method of claim 12 wherein:

said package is formed to have a flap; and said predetermined portion of said package includes an area of said flap, said area of said flap adapted to be top off at said cut.

23. The method of claim 12 wherein forming said package comprises:

forming a sleeve comprised of said outer substrate layer and said inner aseptic layer;

forming a bottom of said package;

filling said package with a predetermined amount of a product; and forming a top of said package.

24. A method for opening a package, said package having a top, a bottom, a flap, a joint, a plurality of sides, and a cut, said method comprising:

extending said flap from one of said sides of said package;

extending at least a portion of said joint from said top and said flap of said package;

moving at least a portion of said top in a direction away from said bottom of said package;

grasping a predetermined portion of said package; and tearing off said predetermined portion of said package at said cut;

whereby said top is in an elevated position after said predetermined portion is torn off.

25. The method of claim 24 wherein said portion of said top is moved in a direction away from said bottom of said package by lifting said portion of said joint.

26. The method of claim 24 wherein said portion of said top is moved in a direction away from said bottom of said package by squeezing opposing ones of said sides of said package.

27. The method of claim 24 wherein:

said predetermined portion of said package includes an area of said top and an area of said flap; and said area of said top and said area of said flap are torn off.

28. The method of claim 24 wherein said package is an aseptic package.

29. The method of claim 24 wherein said package has a second flap and further comprising extending said second flap from one of said sides of said package.

30. The method of claim 29 wherein substantially all of said joint is extended from said top and said flaps of said package.

31. The method of claim 30 wherein substantially all of said top is moved in a direction away from said bottom of said package.

* * * * *